US005799571A

United States Patent [19]

Lee et al.

[11] Patent Number: 5,799,571

[45] Date of Patent: Sep. 1, 1998

[54] POSITIONING DEVICE FOR AN EXTENTABLE TABLE

[76] Inventors: Hsi-lun Lee; Tseng-jung Lee, both of 6th Fl., No. 303, Tzuli 1st Rd., Sanmin Dist., Kaohsiung, Taiwan

[21] Appl. No.: 742,763

[22] Filed: Nov. 1, 1996

[51] Int. Cl.[6] ..... A47B 1/00

[52] U.S. Cl. ..... 108/86

[58] Field of Search ..... 108/86, 83, 85, 108/89

[56] References Cited

U.S. PATENT DOCUMENTS

| | | | |
|---|---|---|---|
| 543,794 | 7/1895 | Zalikowski | 108/86 |
| 606,834 | 7/1898 | Curl | 108/86 |
| 614,751 | 11/1898 | Pangburn | 108/86 |
| 647,652 | 4/1900 | Durgin | 108/86 |
| 676,878 | 6/1901 | Dickey | 108/86 |
| 1,227,102 | 5/1917 | Amsel et al. | 108/86 |
| 2,195,682 | 4/1940 | Romeo | 108/86 X |
| 3,336,883 | 8/1967 | Wengi | 108/86 |
| 4,553,485 | 11/1985 | Lee | 108/86 |
| 4,794,869 | 1/1989 | Chiu | 108/86 |
| 5,577,450 | 11/1996 | Huang | 108/86 |

*Primary Examiner*—José V. Chen
*Attorney, Agent, or Firm*—Bacon & Thomas

[57] ABSTRACT

A positioning device for an extentable table includes a plurality of stops having a plurality of holes defined therein and a central plate having a plurality of bosses formed on two opposed side faces thereof. Therefore, when the central plate is in storage state, the bosses will be inserted into the holes of the stops to securely retain the central plate in position.

4 Claims, 3 Drawing Sheets

POSITIONING DEVICE FOR AN EXTENTABLE TABLE

FIELD OF THE INVENTION

The present invention generally relates to a positioning device, and more particularly to a positioning device for an extendable table which is able to be extended when required and a part of which is able to be concealed when not required.

BACKGROUND OF THE INVENTION

Extendable tables are very popular in modern families, especially for those who often have many occasions to hold a party in their homes, because such tables can accord to the number of guests to decide how much space they are going to use by an extendable table. Usually an extendable table is constructed to have two side leaves moving simultaneously by means of tracks and gears which connect the two side leaves together, a central plate concealed underneath the two side leaves when being connected with each other and of course a plurality of legs securely connected to a base having the tracks and the gears mounted thereon. When the two side leaves moves apart by means of the tracks and the gears, the central plate is then able to be lifted upward and placed between the two side leaves and abut to each other. Such a table provides a first space to the central plate for storage but no positioning device to fix the central plate. Therefore, the central plate will slide out of the table while being transported from one place to another place. To prevent damage to the central plate, workers often wrap it with sponge or some shock absorbing/protective material before transportation, or they will transport the table and the central plate separately, which will increase the size of the whole table and the cost of transporting it.

From the previous description, it is noted that a extendable table described above is unable to fulfill the practical requirements. Thus, a positioning device for an extendable table constructed in accordance with the present invention tends to mitigate and/or obviate the aforementioned problems.

SUMMARY OF THE INVENTION

The main objective of the invention is to provide a positioning device for an extendable table which is able to retain a central plate which is normally concealed underneath two side leaves of the table. The two side leaves each are connected to two racks and are able to move simultaneously by means of two gears each mounted between the two side leaves and mated with each of the racks. The central plate concealed underneath the two side leaves is constructed to have a plurality of protrusions on side faces thereof such that the central plate is able to be securely retained within a first space provided under the table by means of a plurality of stops mounted on two connecting plates. The stops each are provided with a plurality of holes so that the protrusions of the central plate are able to be inserted therein when the central plate is received within the first space.

Another objective of the invention is to provide two transverse bars on a back face of the central plate so that the rigidity of the central plate will be strengthened.

Other objects, advantages and novel features of the invention will become more apparent from the following detailed description when taken in conjunction with the accompanying drawings.

BRIEF DESCRIPTION OF THE DRAWINGS

The present invention will now be better understood with reference to the following drawings, wherein.

DETAILED DESCRIPTION OF THE PREFERRED EMBODIMENT

Figure 1:
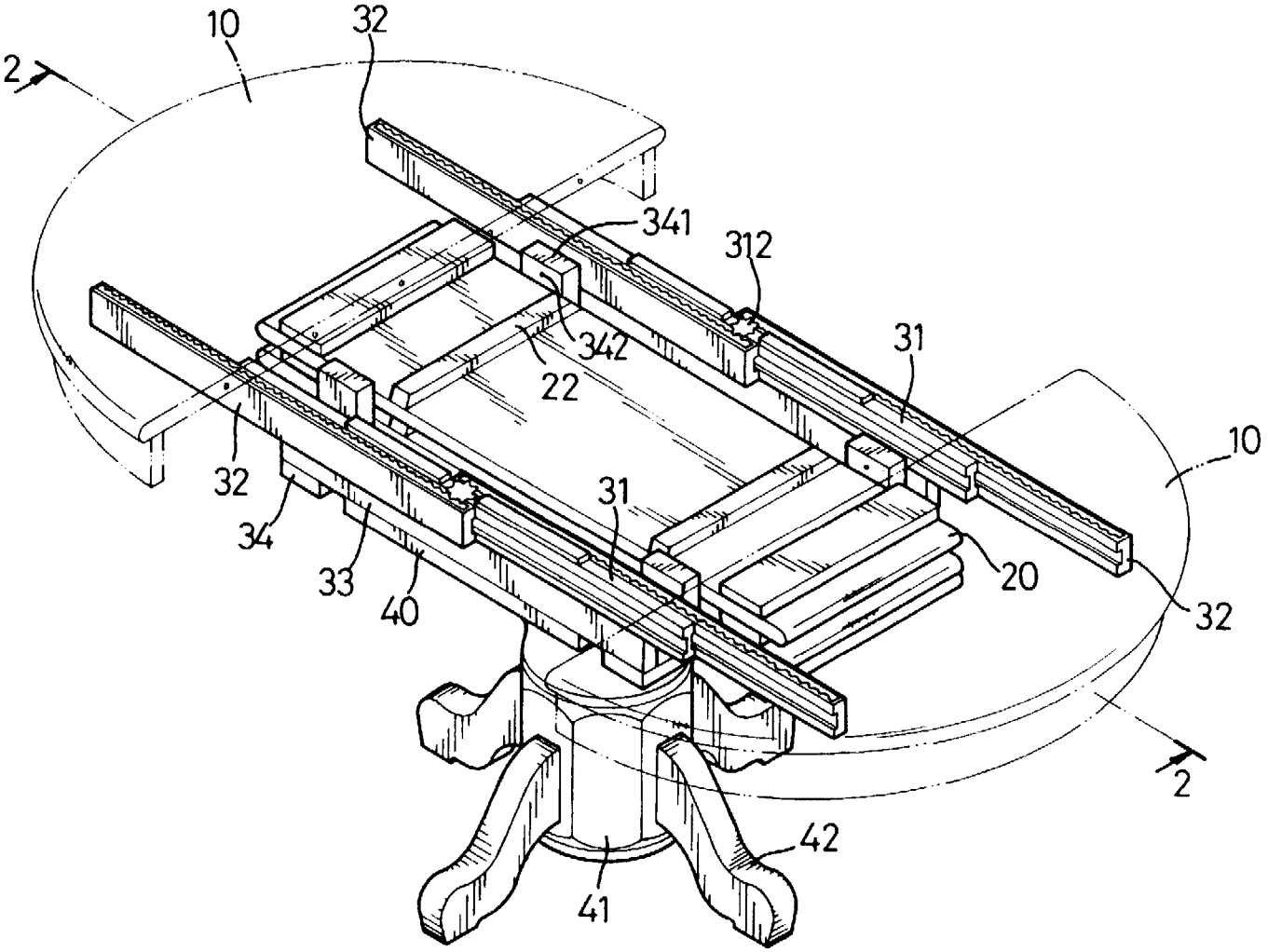
FIG. 1 is a perspective view of an extendable table constructed in accordance with the present invention.
Figure 3:
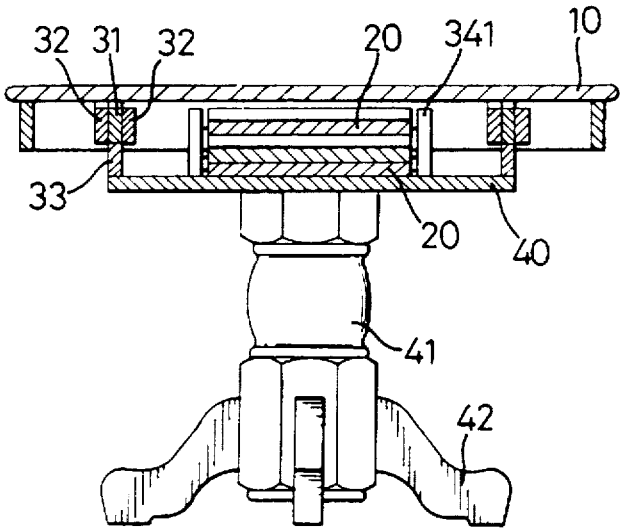
FIG. 3 is an end view of the extendable table shown in FIG. 2.
Figure 4:
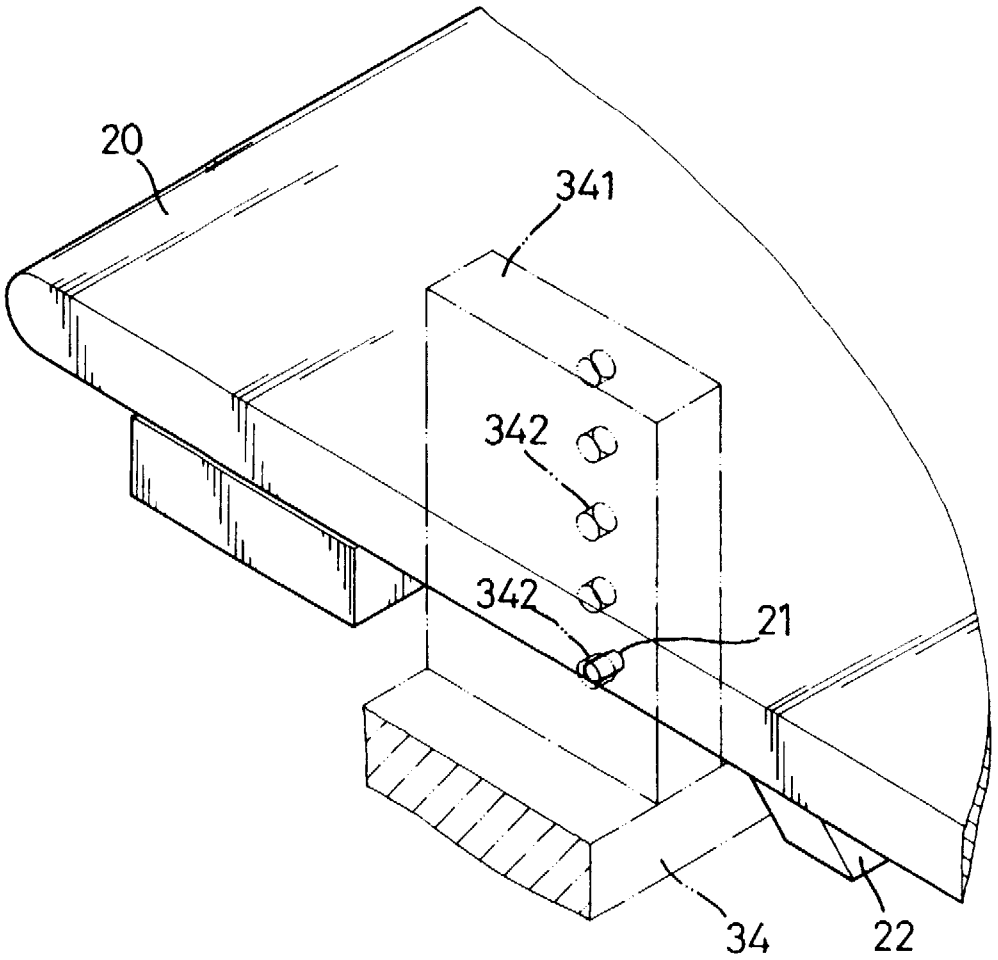
FIG. 4 a partial perspective view of a positioning device of the invention.

Referring to FIG. 1, a extendable table having a positioning device (not numbered) constructed in accordance with the present invention is shown. The table is provided with a plurality of legs 42, a central column 41, side faces of which have securely connected thereto the plurality of legs 42, a base 40 securely connected to an upper face of the central column 41 and to a bottom face (not numbered) of an extending plate 33, two connecting plates 34 spaced apart from the base 40 and securely attached to the bottom face of the extending plate 33, two guiding tracks 31 securely connected onto an upper face of the extending plate 33, two gears 312 mounted at a central portion of each of the guiding track 31, and two pairs of racks 32 each pair of which is securely and respectively connected to a side leaf 10 and mated with the gear 312. With a thus constructed table, the two side leaves 10 are able to be pulled apart by means of a user urging the racks 32 and the guiding tracks 31 and a first space between the two side leaves 10 is then defined. FIGS. 1 and 4 also shows that a plurality of central plates 20 are received within a first space (not numbered) defined by the base 40, the connecting plates 34 and the extending plates 33. As seen from FIG. 3 that the base 40 is securely connected to an upper face of the central column 41 and the extending plate 33 is aligned with the guiding track 31 and also the disposal of the connecting plate 34 is perpendicular to that of the extending plate 33, such that the first space allowing the central plate 20 to be received therein is thus defined.

Figure 2:
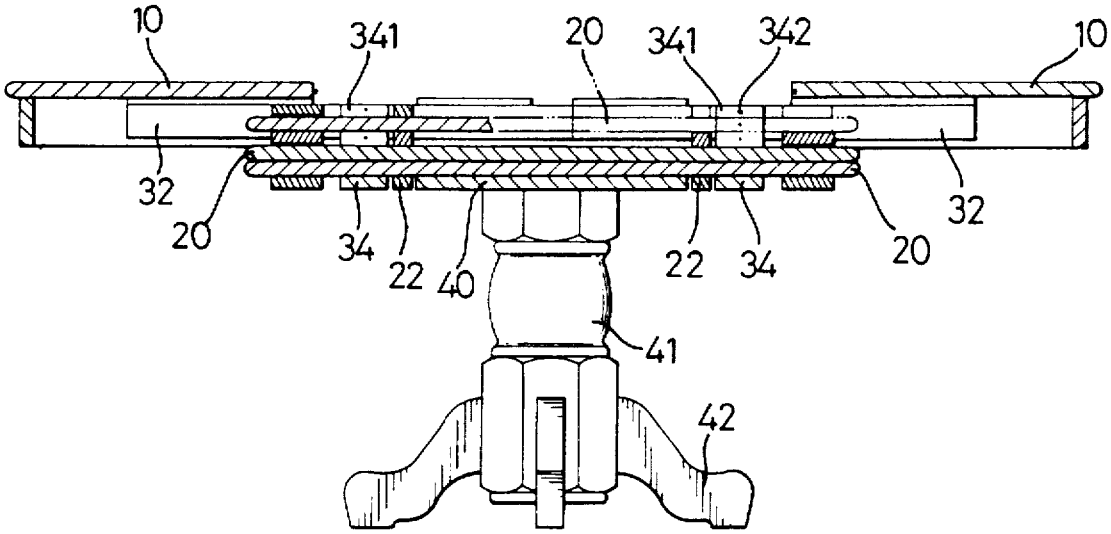
FIG. 2 is a side view of the table shown in FIG. 1.

Referring to FIGS. 1 and 2, two transverse bars 22 are formed on a face of each of the central plates 20 and when the central plates 20 are received within the first space of the table, the transverse bars 22 are positioned between a second space defined by the connecting plate 34 and the base 40, such that the central plates 20 are confined within the second space. Furthermore, a plurality of bosses 21 are formed on two opposed side faces of each of the central plates 20, and a plurality of stops 341 having a plurality of holes 342 defined therein are formed on the connecting plate 34, so that, when the central plates 20 are received within the first space of the table, not only do the transverse bars 22 confine the central plates 20 within the first space, but also the bosses 21 of the central plates 20 will be inserted into the holes 342 of the stops 341 to further confine the central plates 20, as seen in FIG. 4.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A positioning device for an extendable table having a plurality of legs, a central column securely connected with said plurality of legs, a base securely connected to an upper face of said central column an extending plate securely attached to a top of said base, two connecting plates spaced apart and securely attached to a bottom face of said extending plate, two guiding tracks securely connected onto an upper face of the extending plate, two gears mounted at a central portion of each of said guiding tracks, two pairs of racks, one rack of each of the two pairs mated with one of the two gears, two side leaves each of which are connected to one part of said two pairs of racks, such that a storage space is defined by said base, said connecting plates and said extending plates, the improvements comprising:

a) a central plate removably located between said two side leaves so as to be substantially co-planar therewith, the central plate having a plurality of bosses extending from at least one side thereof so as to engage corresponding holes in at least one of said side leaves when said central plate is located between the side leaves; and, b) a plurality of stops connected to said connecting plates, each stop having at least one hole therein to accept a boss of said central plate to mount said central plate in said storage space beneath said side leaves when removed from between the side leaves.

2. The positioning device for an extendable table as claimed in claim 1 further comprising at least two spaced apart transverse bars connected to a back face of said central plate.

3. The positioning device for an extendable table as claimed in claim 2, wherein a distance between said two transverse bars is at least the same as a distance between said two opposed racks.

4. The positioning device for an extendable table as claimed in claim 3, wherein said transverse bars are received in a space defined by said connecting plate and said base.

* * * * *